US009388028B2

(12) United States Patent
Citron et al.

(10) Patent No.: US 9,388,028 B2
(45) Date of Patent: Jul. 12, 2016

(54) STEERING AND LOADING FULCRUM DEVICE FOR MULTI-STAGE LIFTS

(71) Applicant: LiftSmart, LLC, Oceanside, CA (US)

(72) Inventors: Steven Citron, Oceanside, CA (US); John Joseph Busuttil, Kirkland, WA (US); Mark Mattson, Oceanside, CA (US)

(73) Assignee: LIFTSMART, LLC, Oceanside, CA (US)

( * ) Notice: Subject to any disclaimer, the term of this patent is extended or adjusted under 35 U.S.C. 154(b) by 509 days.

(21) Appl. No.: 13/750,797

(22) Filed: Jan. 25, 2013

(65) Prior Publication Data

US 2013/0192931 A1 Aug. 1, 2013

Related U.S. Application Data

(60) Provisional application No. 61/591,692, filed on Jan. 27, 2012.

(51) Int. Cl.
*B66F 9/075* (2006.01)

(52) U.S. Cl.
CPC ..... *B66F 9/07568* (2013.01)

(58) Field of Classification Search
CPC ..... B66F 5/00
USPC ..... 187/231, 226
See application file for complete search history.

(56) References Cited

U.S. PATENT DOCUMENTS

| | | | | |
|---|---|---|---|---|
| 186,241 | A | 1/1877 | Fogg | |
| 859,718 | A | 7/1907 | Abbott | |
| 2,620,198 | A * | 12/1952 | Johnston | B66F 5/00 188/119 |
| 2,885,961 | A * | 5/1959 | Hopfeld | 74/101 |
| 3,752,261 | A | 8/1973 | Bushnell, Jr. | |
| 4,015,686 | A | 4/1977 | Bushnell, Jr. | |
| 4,502,568 | A * | 3/1985 | Lebre | 187/231 |
| 5,042,962 | A * | 8/1991 | Lechnir | 414/452 |
| 5,645,142 | A | 7/1997 | Kraemer et al. | |
| 5,875,869 | A * | 3/1999 | Busuttil et al. | 182/69.6 |
| 5,941,543 | A * | 8/1999 | Kazmark, Jr. | B62B 1/002 280/47.29 |
| 6,511,080 | B2 * | 1/2003 | Lee | 280/43.12 |
| 8,863,899 | B2 * | 10/2014 | Solhjem | B66F 11/04 182/133 |

FOREIGN PATENT DOCUMENTS

FR 541611 A 7/1922

* cited by examiner

*Primary Examiner* — William E Dondero
*Assistant Examiner* — Diem Tran
(74) *Attorney, Agent, or Firm* — Kilpatrick Townsend & Stockton LLP

(57) ABSTRACT

A multi-stage lift having an adjustable height steering handle/loading bar. The steering handle/loading bar is rotatably mounted to the lift, and can be rotated and locked at different positions.

14 Claims, 5 Drawing Sheets

STEERING AND LOADING FULCRUM DEVICE FOR MULTI-STAGE LIFTS

CROSS-REFERENCES TO RELATED APPLICATIONS

The present application claims the benefit of U.S. Provisional Application No. 61/591,692, filed on Jan. 27, 2012, the full disclosure of which is incorporated herein by reference.

SUBJECT MATTER

A self-contained, spring actuated and vertically adjustable steering and loading fulcrum device for multi-stage lifts.

BACKGROUND

U.S. Pat. No. 4,015,686 discloses a multi-stage lift which was in commercial production for many years. In this lift the stages comprise like extruded aluminum mast sections which interfit in front to back relation and are separated in the front to back direction by guide rollers. The lift stages are elevated by operation of a reeving system including a cable between a rear winch and a front carriage which passes over top and bottom pulleys in each extensible stage, a top pulley on the back stationary stage, and a pulley on the carriage.

U.S. Pat. No. 5,645,142 discloses a substantially similar multi-stage lift which has been in commercial production for many years. In this lift the stages comprise like extruded aluminum mast sections which interfit in front to back relation and are separated in the front to back direction by guide rollers. The lift stages are elevated by operation of a reeving system including a cable between a rear winch and a front carriage which passes over top and bottom pulleys in each extensible stage, a top pulley on the back stationary stage, and a pulley on the carriage.

The types of lifts disclosed above are lightweight and highly portable. They are typically manually-propelled, pushed or pulled by the machine operator to lift, position, and/or move moderately heavy materials from one location to another. They are also easily loadable into a pickup truck and commonly transported from one job site to another or to and from an equipment rental yard. These lifts are commonly operated by a dual-handled winch located at the rear of the machine.

Because the dual winch handles rotate and are not fixed in position, they are not ideal for steering the machine while maneuvering it around. Applicants have found that it is more ideal to have a fixed steering handle for manually moving the lift around the job site. Applicants have also found that such steering handle should be located at an ideal position for use as a fulcrum or pivot point for tipping the machine on its back when loading the lift into the back of a pickup truck or trailer for transportation of the machine to alternate locations. What has been found by the applicants is that the ideal position of the combined steering handle and adjustable loading fulcrum interfere with the ideal height of the winch handles that are used when raising and lowering materials.

U.S. Pat. No. 4,015,686 and FIG. 1 disclose an early version of these lifts. There are no steering handles available and the profile of the fixed height loading fulcrum is narrow enough so it will not interfere with the rotation of the dual winch handles while in use. The narrow fulcrum did not provide a means to steer the machine and it was also not very stable when lying on its back during vehicular transport due to the narrow profile of the fulcrum (which the machine rests on during transportation).

U.S. Pat. No. 5,645,142 discloses a subsequent version of these lifts. One can easily note the steering handle, which includes handle grips protruding outward on each side as well as a vertically rotatable design that allows the steering handle to be located in several different height positions relative to what is most comfortable for the individual operator's height for improved ergonomics. In addition, the vertically rotatable design serves two purposes as it also allows for the loading fulcrum to be adjusted relative to the height of a transport vehicle's tailgate or loading ramp. The vertically rotatable design consists of several holes aligned into an arc and a ball detent pin that can be removed and re-inserted into the various holes to adjust the overall height. This allows the operator to use the dual winch handles to raise and lower a load of materials and then raise the steering handles into an optimum position for maneuvering the machine (which in turn more than likely prevents the dual winch handles from moving through their complete range of motion—they would hit the steering handles). Once machine maneuvering is completed, the operator merely pulls the ball detent pin out of the height adjustment hole, lowers the steering handle to a position that would not interfere with the dual winch handles, and then proceeds to operate the winch again. When loading the machine into the back of a pickup truck the operator adjusts the loading fulcrum to an ideal height, keeping the loading wheels of the fulcrum as close as possible to the tailgate height of the pickup truck to make loading easy and more ergonomic. Because the loading fulcrum can be rotated out of the way of the dual winch handles, it can be made at a wider profile to provide a wider stance for improved stability of the machine during transport.

The vertically rotatable design of the combination steering handle and loading fulcrum was somewhat of a breakthrough at the time (nearly 20 years ago) but it has not been improved upon. Although the original design provides inherent improvements compared to prior iterations, it also requires the operator to continually remove and re-insert a ball detent pin manually, each time an adjustment of the combined steering handles and fulcrum is made. The ball detent and adjustment holes can eventually become corroded with rust and can sometimes become very difficult or impossible to remove. The ball detent pin is attached to the machine by a lanyard which is also prone to rust and eventual breakage, allowing the ball detent pin to be separated from the machine and to get lost on the job site.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In embodiments, a multi-stage lift is provided, having a carriage for receiving a load; a lift structure comprising a plurality of mast sections that are translatable to lower and raise the carriage; and an adjustable height steering handle connected to the lift structure. The adjustable height steering handle includes a handle bar; a support bar having a proximal end and a distal end, with the handle bar connected to the proximal end and being rotatably mounted from the distal end to the lift structure; a series of locking slots for selectively locking the support bar in position at points along rotation of the support bar; and a spring for selectively locking the support bar into one of the slots, the spring and slots being configured and positioned such that pulling outward on the support bar via the handle bar and against the bias of the spring moves the support bar out of engagement with one of the slots, permitting rotation of the support bar and engagement of the support bar with another locking slot.

In embodiments, the handle bar includes at least one wheel for serving as a loading fulcrum.

The support bar can include at least one pin for engaging and locking into the locking slots. The locking slots in such an embodiment can be connected by an arcuate opening, where the pin moves along the arcuate opening when the support bar is moved between locking slots.

In further embodiments, the support bar includes a slot that is rotatably mounted to a pin mounted to the lift structure. The pin mounted to the lift structure and said at least one pin for engaging and locking can be biased toward each other by the spring.

In embodiments, at least one of the locking slots comprises a turn in the locking slot to aid in maintaining the support bar in a locked position.

In embodiments, the lift includes first and second plates extending outward from the lift structure, with the support bar rotatably mounted to the first and second plates. The mounting pin can be connected to the first and second plates, with the support bar having a slot that is rotatably mounted on the mounting pin.

In further embodiments, a multi-stage lift is provided, having: a carriage for receiving a load; a lift structure comprising a plurality of mast sections that are translatable to lower and raise the carriage; and an adjustable height steering handle connected to lift structure, the adjustable height steering handle being configured such that, when the handle is locked at a first height, the handle can be pulled out to unlock the handle, and after pulled out and unlocked, can be rotated to a new position and moved inward to lock the handle at the new position.

In embodiments, the handle is biased inward toward the locked position. In further embodiments, the handle includes at least one surface for serving as a fulcrum.

In still further embodiments, a method of manipulating a multi-stage lift is provided. The method includes moving the multi-stage lift via a handle with the handle locked in a first position; pulling out the handle to unlock the handle from the first position; rotating the handle to a new position, the new position having a different height than the first position; and causing the handle to move inward at the new position to lock the handle at the first position.

In embodiments of the method, the handle includes fulcrum wheels, and the method includes: pulling the handle inward to unlock the handle; rotating the handle to a third position to utilize the fulcrum wheels for loading the multi-stage lift onto a vehicle, the third position being a different height than the new position; causing the handle to move inward to lock the handle at the third position; and loading the multi-stage lift via the fulcrum wheels.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments of the present invention include two side plates that have laser cut adjustment slots/arcs positioned along a circumferential groove, a steering handle/loading fulcrum T-bar that inserts between the side plates and is rotatably attached to a back portion of the side plates, and a spring that biases the T-bar into the side plates and provides tension for the T-bar to stay in position while in use. A pair of bolts or axels extends outward from the T-Bar and are arranged to extend in the circumferential groove. These bolts can be selectively moved into the slots/arcs as the T-bar is rotated. To remove the bolts from the slots/arcs, the T-bar is pulled outward against the bias of the spring. The plurality of slots/arcs in the side plates provide multiple height adjustment positioning of the T-bar. Thus, unlike the above-described prior art T-bar, the embodiments described herein do not require an operator to continually remove and re-insert a ball detent pin into holes to adjust a vertical T-bar height. Instead, in accordance with current embodiments, an operator merely pulls up and back (against the spring tension) on the T-bar and then can rotate the T-bar through the laser cut arc/slot into various adjustment positions/slots, providing a much easier and quicker transition when switching back and forth between using the dual winch handles and maneuvering the machine (or loading the machine). The system is completely self-contained, so there are no loose parts or parts attached to the machine with lanyards that can break.

Figure 1:
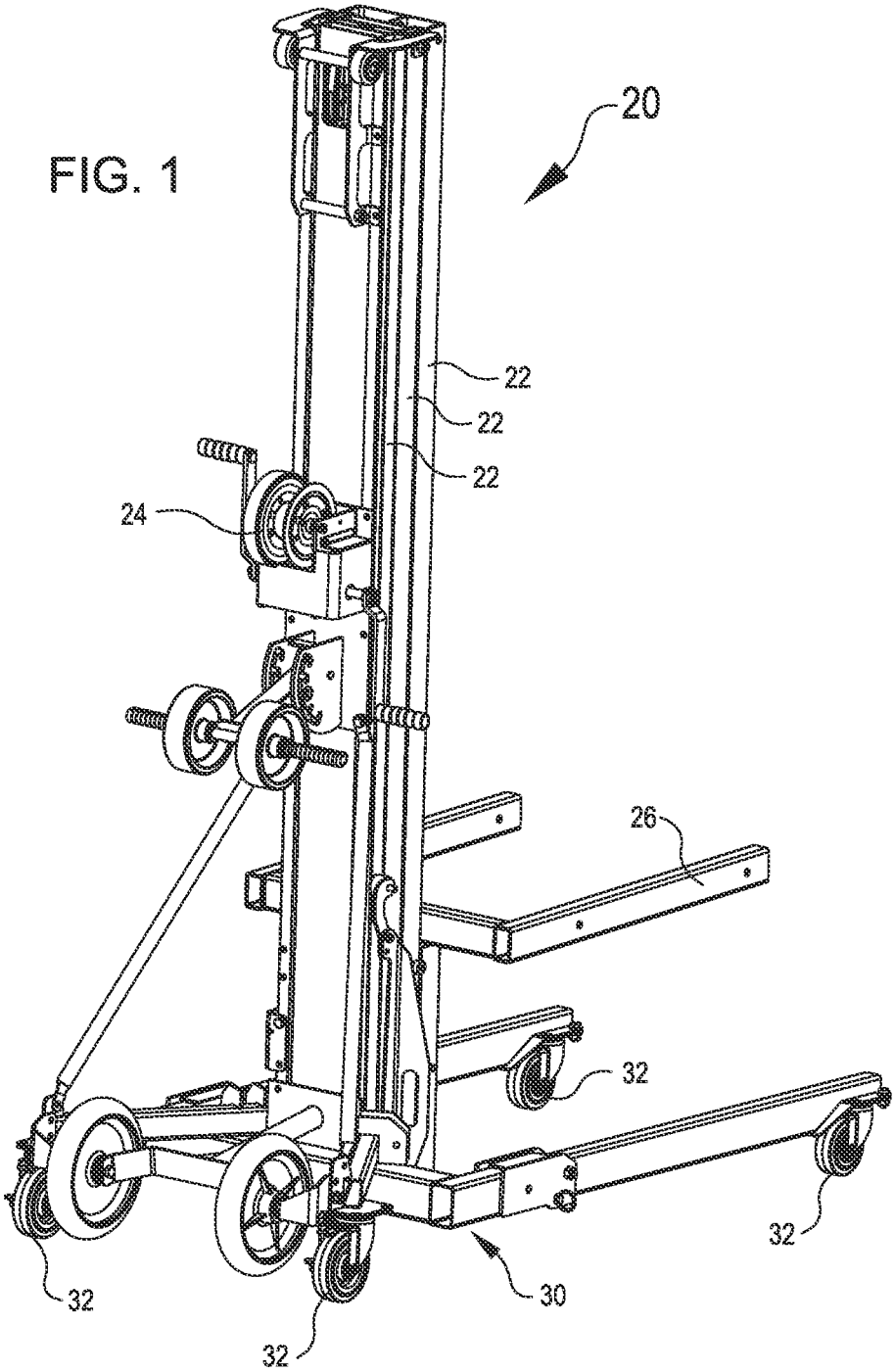
FIG. 1 is a side perspective view of a multi-stage lift in accordance with embodiments.
Figure 2:
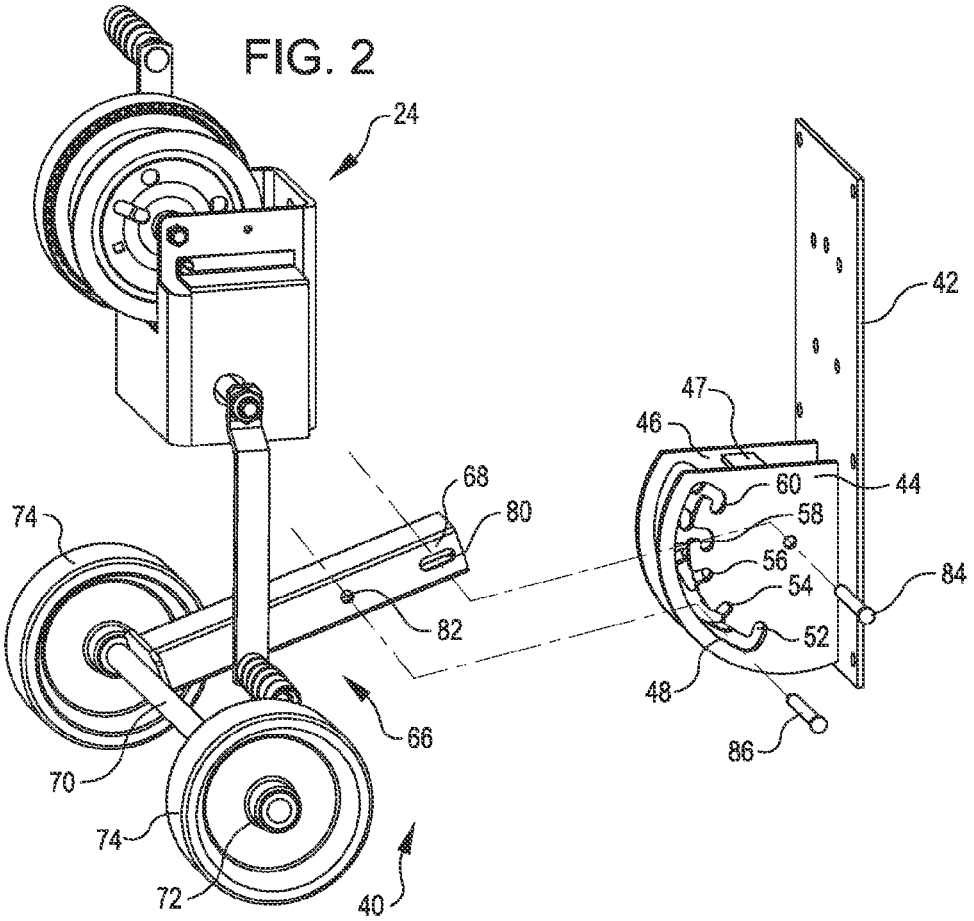
FIG. 2 is an exploded perspective view of a steering handle/loading bar system and winch for the multi-stage lift of FIG. 1.

Referring now to the drawing, in which like reference numerals represent like parts throughout the several views, FIG. 1 shows a perspective view of a multi-stage lift 20 having mast sections 22 which interfit in front to back relation and are separated in the front to back direction by guide rollers. The mast stages 22 are elevated by operation of a reeving system (not shown, but known) including a cable (also not shown) between a rear winch 24 and a front carriage 26. As is known in the art, the cable passes over top and bottom pulleys (not shown) in each extensible mast section 22, a top pulley on the back stationary stage, and a pulley on the carriage 26. The multi-stage lift 20 is positioned on a base 30 with wheels 32. The base 30 can collapse for storage and transport of the multi-stage lift 20.

The components of the multi-stage lift 20 described thus far are known. In accordance with embodiments, however, a novel steering handle/loading bar 40 is provided. In the embodiment shown in the drawings, the steering handle/loading bar 40 is positioned on the back of rear mast section 22, just below the winch 24, but the steering handle/loading bar 40 can be mounted at another location on the back of the rear mast section, or on another position on the multi-stage lift 20.

Figure 3:
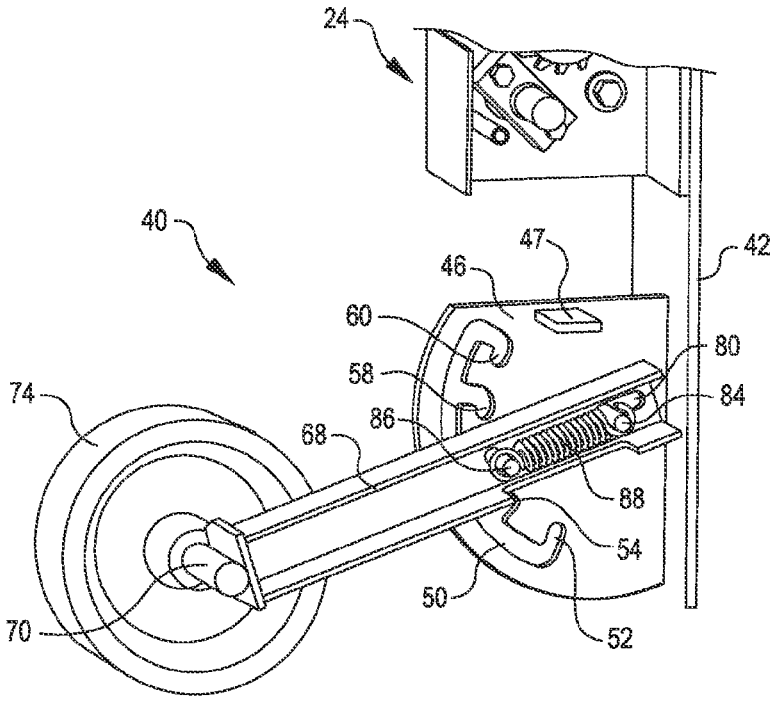
FIG. 3 is a partial cutaway, assembled view of the steering handle/loading bar system and winch of FIG. 2.

As shown in FIG. 3, the steering handle/loading bar 40 can be mounted to a rear plate 42, which in turn is mounted to the rear mast 22. The steering handle/loading bar 40 includes side plates 44, 46 which are spaced from each other by one or more spacers 47. The side plates 44, 46 extend rearwardly from the rear plate 42 and, in the embodiment shown in the drawings, are shaped generally as quarter circles. Arcuate openings 48, 50 are positioned just inward of the outer circumference of the rounded sections of the side plates 44, 46. A series of inwardly-directed radial slots 52, 54, 56, 58, 60 are located along the arcuate openings. In the embodiment shown in the drawings, there are five inwardly-directed radial slots, but any number can be used.

The steering handle/loading bar 40 includes a T-bar 66 having a base bar 68 and a handle bar 70. The handle bar 70 is connected to the base bar 68 so as to form a "T". Handles 72 are positioned at distal ends of the handle bar 70, and wheels 74 are mounted on the handle bar 70 just inside the handles 72.

The base bar 68 includes a slot 80 extending along a short portion of its length and positioned at the distal end of the base bar. A hole 82 is positioned proximal of the slot 80 on the base bar 68.

Two pins 84, 86 are used to mount the base bar 68 to the side plates 44, 46. Although described as "pins", the pins 84, 86 can be bolts, axels, or any other structure that can provide the functions described herein. A first, rear pin 84 extends into holes 88 in a rear portion of the side plates 44, 46, and through the slot 80 on the base bar. The base bar 68 is positioned between the two side plates, and thus the pin 84 extends through one side plate 44, through the slot 80, and into the opposite side plate 46. The base bar is free to rotate and slide along the pin, and is limited in sliding by the length of the slot. Although a slot and pin arrangement is shown, other mounting arrangements can be provided to permit rotation and sliding of the base bar 68.

The second pin 86 is mounted in the hole 82 in the base bar 68. This pin 86 is fixed to the base bar 68. The pin 86 extends out of the arcuate openings 48, 50 and/or the slots 52, 54, 56, 58, 60, depending upon the position of the base bar 68, as described below.

A spring 88 is connected to the two pins 84, 86 and biases the two pins together. The spring 88 can alternatively be any structure that draws the base bar 68 forward in the side plates.

In use, the handle bar 70 of the steering handle/loading bar 40 can be moved up and down and can be locked into different locations by pulling out on the handles 72 and rotating the base bar 68 to a desired location. In doing so, the pin 86 is moved from one of the slots 52, 54, 56, 58, or 60 to another. The spring 88 biases the T-bar 66 forward into the side plates 44, 46 and provides tension for the T-bar to lock, or stay in position, in one of the slots during normal operation. A user can grab the handles 72 and pull outward on the T-bar 66, against the bias of the spring 88. During this movement outward, the slot 80 moves along the pin 84. When the T-bar is moved outward far enough, the end of the slot 80 is engaged by the first pin 84, and the second pin 86 is aligned with the arcuate openings 48, 50. The user can then rotate the T-bar 66 to align it with another slot 52, 54, 56, 58, or 60. The T-bar 66 can then be released (or tension can be reduced), and the spring 88 draws the T-bar 66 forward, with the pin 86 entering the new slot. In this manner, the position of the T-bar 66 is adjustable up and down, providing multiple height adjustment positioning of the T-bar. At each new location, the T-bar 66 can be locked into a new slot 52, 54, 56, 58, or 60.

Figure 4:
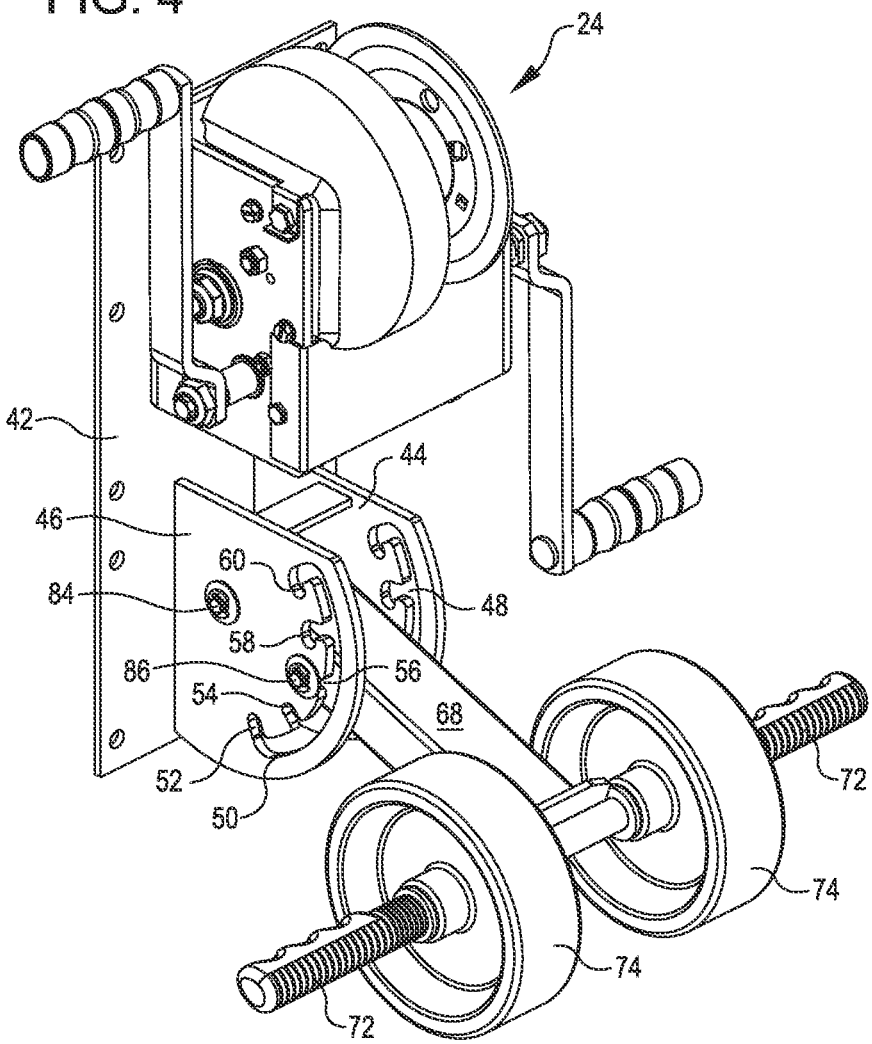
FIG. 4 is a side perspective view of the steering handle/loading bar system and winch of FIG. 3.
Figure 5:
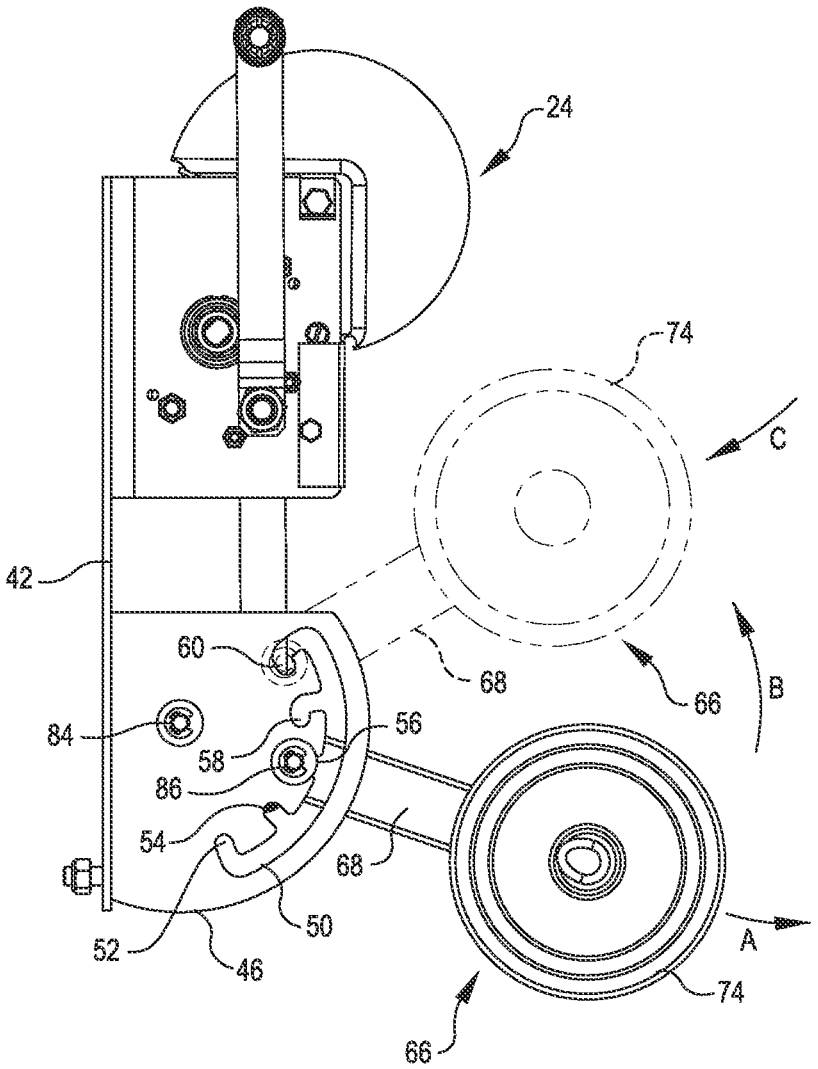
FIG. 5 is a side view of the steering handle/loading bar system and winch of FIG. 4.
Figure 6:
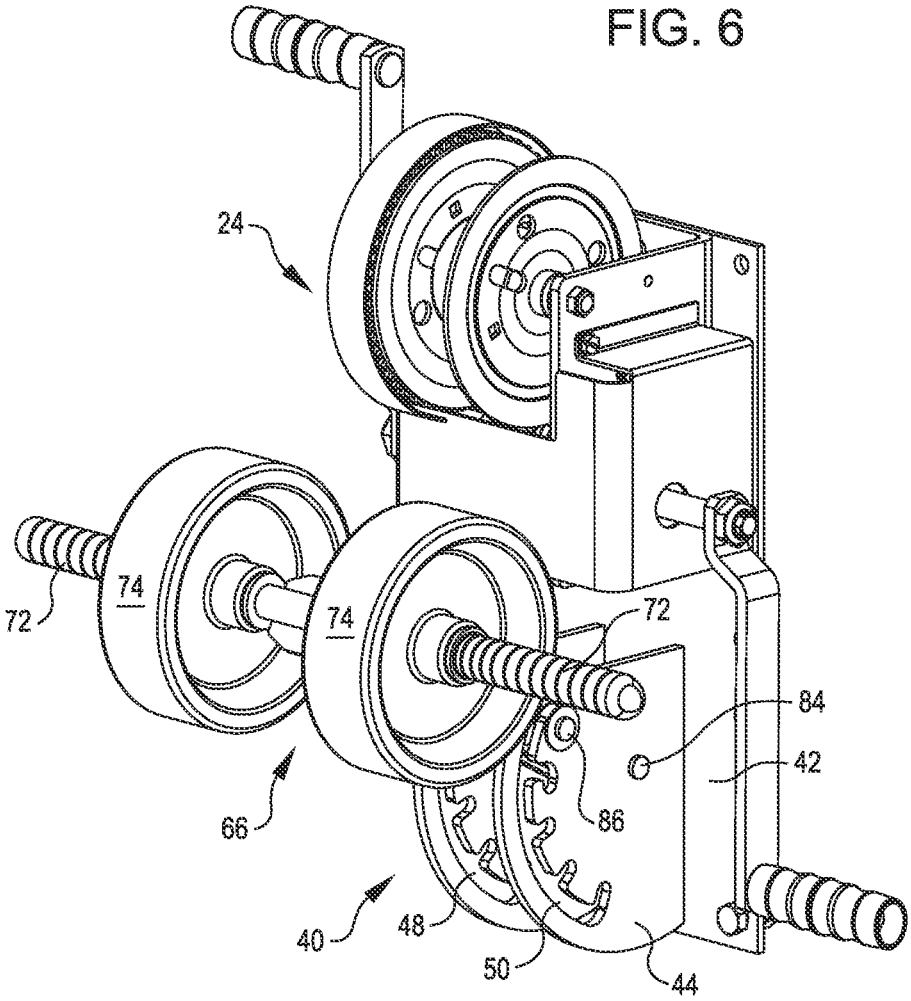
FIG. 6 is a side perspective view of the steering handle/loading bar system and winch of FIG. 5, after a T-bar for the system has been moved to a higher location.

For example, the T-bar 66 can start in a position, shown in FIG. 4, where the pin 86 is positioned in the middle slots 56. To remove the pin 86 from the slots 56, the T-bar 66 is pulled outward, in the direction of the arrow A in FIG. 5, against the bias of the spring 88. The T-bar 66 can then be rotated in the direction of the arrow B in FIG. 5, to another slot, such as the slot 60. The T-bar 66 is then moved inward, physically by the user and/or via the bias of the spring 88, into the new slot 60, as shown by the arrow C in FIG. 5. The final position is shown in FIG. 6, where the T-bar 66 is at a higher position.

Thus, unlike the above-described prior art T-bar, the embodiments described herein do not require an operator to continually remove and re-insert a ball detent pin into holes to adjust a vertical T-bar height. Instead, in accordance with current embodiments, an operator merely pulls up and back (against the spring tension) on the T-bar 66 and then can rotate the T-bar through the arc/slot into various adjustment positions/slots, providing a much easier and quicker transition when switching back and forth between using the dual winch handles and maneuvering the machine (or loading the machine). The system is completely self-contained, so there are no loose parts or parts attached to the machine with lanyards that can break.

In embodiments, the slots 52, 54, 56, 58, or 60 can bend along their length, to further aid in locking of the T-bar 66. For example, as shown in FIG. 5, the slots 58 and 60 includes a turn downward at a distal end of the slot. A user can direct the pin 86 into the turned end of the slots to further lock the pin into the slots. Moreover, because the slots 58, 60 open downward into the arcuate openings 48, 50, the downward turns at the ends of the slots can prevent any effect of gravity.

The steering handle/loading bar 40 can be adjusted to a proper height so that a user can manipulate the multi-stage lift 20 via the handles 72. Moreover, the loading wheels 74 can be quickly re-positioned to eliminate interference with the handles on the winch 24, or to be properly positioned for loading. Although loading wheels are shown in the drawings, any form of fulcrum surface could be provided.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A multi-stage lift, comprising:

a carriage for receiving a load;

a lift structure comprising a plurality of mast sections that are translatable to lower and raise the carriage; and an adjustable height steering handle comprising:

a base mounted to the lift structure, the base including a series of locking slots;

a support bar having a first end and a second end, the first end of the support bar being mounted to the base to accommodate rotation and translation of the support bar relative to the base, the support bar being configured to be engaged with each of the series of locking slots via a translation of the support bar relative to the base to lock the support bar in a respective orientation relative to the base;

a handle bar connected to the second end of the support bar; and a spring connected between the base and the support bar so as to apply a biasing force to the support bar to bias the support bar toward the base and into engagement with any selected one of the series of locking slots, the spring and series of locking slots being configured and positioned such that pulling the support bar away from the base via the handle bar and against the biasing force of the spring translates the support bar relative to the base and out of engagement with one of the series of locking slots, permitting rotation of the support bar and engagement of the support bar with another locking slot of the series of locking slots.

2. The multi-stage lift of claim 1, wherein the handle bar comprises at least one wheel for serving as a loading fulcrum.

3. The multi-stage lift of claim 1, wherein the support bar comprises at least one pin for engaging and locking into the series of locking slots.

4. The multi-stage lift of claim 3, wherein the series of locking slots are connected by an arcuate opening, and wherein the pin moves along the arcuate opening when the support bar is moved between locking slots of the series of locking slots.

5. The multi-stage lift of claim 3, wherein the support bar comprises a slot that is rotatably mounted to a pin mounted to the base.

6. The multi-stage lift of claim 4, wherein the pin mounted to the base and said at least one pin for engaging and locking are biased toward each other by the spring.

7. The multi-stage lift of claim 1, wherein at least one of the series of locking slots comprises a curved portion configured to aid in maintaining the support bar in a locked position.

8. The multi-stage lift of claim 1, wherein the base comprises first and second plates extending outward from the lift structure, and wherein the support bar is mounted to the first and second plates.

9. The multi-stage lift of claim 8, further comprising a mounting pin connected to the first and second plates, and wherein the support bar comprises a slot that is rotatably mounted on the mounting pin.

10. A multi-stage lift, comprising:

a carriage for receiving a load;

a lift structure comprising a plurality of mast sections that are translatable to lower and raise the carriage;

a base connected to the lift structure; and an adjustable height steering handle connected to the base so at to be translatable and rotatable relative to the base, the adjustable height steering handle being configured such that, when the adjustable height steering handle is locked at a first height, the adjustable height steering handle can be pulled out to translate the adjustable height steering handle relative to the base to unlock the adjustable height steering handle, and after the adjustable height steering handle is pulled out and unlocked, the adjustable height steering handle can be rotated to a new position and translated toward the base to lock the adjustable height steering handle at the new position.

11. The multi-stage lift of claim 10, wherein the adjustable height steering handle is biased inward toward a locked position.

12. The multi-stage lift of claim 10, wherein the adjustable height steering handle comprises at least one surface for serving as a fulcrum.

13. A method of manipulating a multi-stage lift, the method comprising:

moving the multi-stage lift via a handle with the handle locked in a first position relative to a base to which the handle is mounted for rotation and translation relative to the base;

pulling out the handle away from the base to unlock the handle from the first position;

rotating the handle to a new position relative to the base, the handle having a different height in the new position relative to the first position; and causing the handle to move inward toward the base at the new position to lock the handle at the first position.

14. The method of claim 13, wherein the handle comprises fulcrum wheels, and the method further comprising:

translating the handle relative to the base to unlock the handle;

rotating the handle relative to the base to a third position to utilize the fulcrum wheels for loading the multi-stage lift onto a vehicle, the handle having a different height in the third position relative to the new position;

causing the handle to move inward toward the base to lock the handle at the third position; and loading the multi-stage lift onto the vehicle via the fulcrum wheels.

* * * * *